US005117221A

United States Patent [19]

Mishica, Jr.

[11] Patent Number: 5,117,221

[45] Date of Patent: May 26, 1992

[54] LASER IMAGE PROJECTION SYSTEM WITH SAFETY MEANS

[75] Inventor: Robert J. Mishica, Jr., Chanhassen, Minn.

[73] Assignee: Bright Technologies, Inc., Philadelphia, Pa.

[21] Appl. No.: 568,395

[22] Filed: Aug. 16, 1990

[51] Int. Cl.[5] ..... G08B 13/18

[52] U.S. Cl. ..... 340/556; 250/221; 352/131; 353/122

[58] Field of Search ..... 340/556, 323 R, 557, 340/573, 567; 250/221; 455/617; 352/131; 353/97, 121–122; 272/8 P, 10; 273/358; 446/175; 361/173

[56] References Cited

U.S. PATENT DOCUMENTS

| | | | |
|---|---|---|---|
| 3,688,298 | 8/1972 | Miller et al. | 340/557 |
| 3,851,961 | 12/1974 | Winzer | 353/122 X |
| 3,920,319 | 11/1975 | Bryant | 352/131 X |
| 4,249,074 | 2/1981 | Zettler et al. | 250/221 |
| 4,288,158 | 9/1981 | Frügel | 340/689 X |
| 4,408,195 | 10/1983 | Tullis et al. | 340/557 X |
| 4,902,889 | 2/1990 | Sodi | 250/221 X |

FOREIGN PATENT DOCUMENTS

| | | | |
|---|---|---|---|
| 3501598 | 7/1986 | Fed. Rep. of Germany | 340/556 |
| 1229100 | 5/1986 | U.S.S.R. | 340/556 |
| 2183332 | 6/1987 | United Kingdom | 340/556 |

*Primary Examiner*—Jin F. Ng
*Assistant Examiner*—Thomas J. Mullen, Jr.
*Attorney, Agent, or Firm*—Caesar, Rivise, Bernstein, Cohen & Pokotilow, Ltd.

[57] ABSTRACT

An image projection system and method of use at a venue, e.g., a sports or entertainment arena, having an area or field into which an image is to be projected by the system. The system includes laser devices and associated components, e.g., a computer-based controller, for generating and projecting the image into the field. The projection system additionally comprises an override subsystem, e.g., infrared transmitters and associated detectors, forming an enclosure surrounding the field for determining if a living being has entered the field and for providing an electrical signal indicative thereof. This signal may be used automatically or manually for effecting the termination of the display.

34 Claims, 5 Drawing Sheets

HOME 102 VISITOR 98
FIF .... FOUL ....
TIME 5:17
SLAM DUNK
20
22
26
28
30

LASER IMAGE PROJECTION SYSTEM WITH SAFETY MEANS

BACKGROUND OF THE INVENTION

The invention relates generally to image projection systems, and more particularly to laser based projection systems for use in arenas, theaters, etc.

Various systems have been proposed and some are commercially available for producing a large color image, be it graphic and/or text onto a viewing panel for entertainment or informational purposes. One type of system employs a matrix or array of large colored incandescent lamps, each establishing a pixel of the image, and which are driven, e.g., energized and deenergized by a control system. While such systems are generally suitable for their intended purposes they nevertheless exhibit various drawbacks or limitations. For example such systems are necessarily large and complex, require substantial power, are expensive to operate and maintain, and are not generally suitable for producing complex, high resolution images. Optical fiber-based projection systems have also been proposed. While such systems may offer some advantages over the incandescent lamp based systems they still leave much to be desired from the standpoint of complexity, size, and particularly inability to produce complex, high resolution images.

Systems using laser devices to project a large scale image onto a surface have been proposed and some are commercially available. Such systems typically make use of computercontrolled vector scanning techniques to project a static or dynamic color image onto some surface, e.g., a wall. The following companies produce and sell such systems: Laser Media, Inc. of Los Angeles, Calif., Image Engineering, Inc. of Springfield Mass., Science Faction of New York, N.Y., Laser Fantasy of Redmond Calif., and Laser Images of Los Angeles, Calif.

Owing to the inherent limitations of vector scanning the prior art laser projection systems have been somewhat limited in the type of images produced thereby. In particular such images have tended to be line art. However, development is underway of laser projection systems utilizing raster scanning to thereby produce the type of complex, high resolution images presently produced by conventional television. Thus, the future is ripe for the implementation of laser based projection systems.

The ability to project a laser image onto a floor or some other surface in an arena or other facility is of considerable desirability and could soon become an ideal means of preprogrammed or real time communication for the sporting and special event audience. In this regard sponsor logos, team logos, mascots, animation, advertising, and other visual effects could be projected for ready visibility by the audience during pregame time, during timeouts, etc. However, if the laser projection system is to be used in such applications, since persons could intrude into the area in which the laser beam(s) is(are) projected they may be subjected to potential injury from the projected beam(s). Heretofore prior art laser projections systems have avoided that potential problem by confining the use of such systems to applications wherein the laser light is projected into a space which is not accessible by the public.

Accordingly, the need exists for a projection system suitable for projecting a laser-based image into an area which is accessible by the public, yet which is safe and meets the requirements of the Bureau of Radiological Health (BRH) of the FDA regarding exposure of persons to laser light.

OBJECTS OF THE INVENTION

It is therefore a general object of this invention to provide a laser-based, image projection system which overcomes the disadvantages of the prior art.

It is a further object of this invention to provide a laser-based, image projection system for projecting a laser image into an area accessible by the public and which includes safety means for protecting any person who might attempt to intrude into that area.

It is still a further object of this invention to provide a laser-based, image projection system for projecting a laser image into an area accessible by the public and which includes safety means for disabling the system in the event that a person attempts to intrude into the area in which the laser light is projected.

It is yet a further object of this invention to provide a method of projecting a laser beam into a space to produce a display of a visually perceptible image therein and to terminate that display in the event that a person should attempt to intrude into that space.

SUMMARY OF THE INVENTION

These and other objects of this invention are achieved by providing an image projection system and method of use at a venue, e.g., a sports or entertainment arena, having a field, e.g., a floor, onto which an image is to be projected thereby.

The image projection system comprises laser means and control means for generating and projecting a laser image into the field. The projection system also includes safety override means coupled to the control means for determining if a living being has entered the field, and for providing an electrical signal indicative thereof. That signal is used to effect the termination of the display either automatically in response thereto, or manually.

In one preferred embodiment of the invention the safety override system comprises transmitter means and associated receiver means. The transmitter means produces electromagnetic radiation, e.g., infrared radiation, and projects it along the periphery of the field to the receiver means. If a living being should traverse the radiation between the transmitter means and the receiver means the receiver means provides an electrical signal indicating such action to the control means, whereupon the control means terminates the laser display.

The method of this invention entails projecting a laser beam onto a field at a venue to produce a visually perceptible image thereon and entails the steps of establishing a predetermined perimeter about said field, generating and projecting the laser-based image into the field, and terminating the projection of said image into the field in the event that a person should pass through the perimeter into said field.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
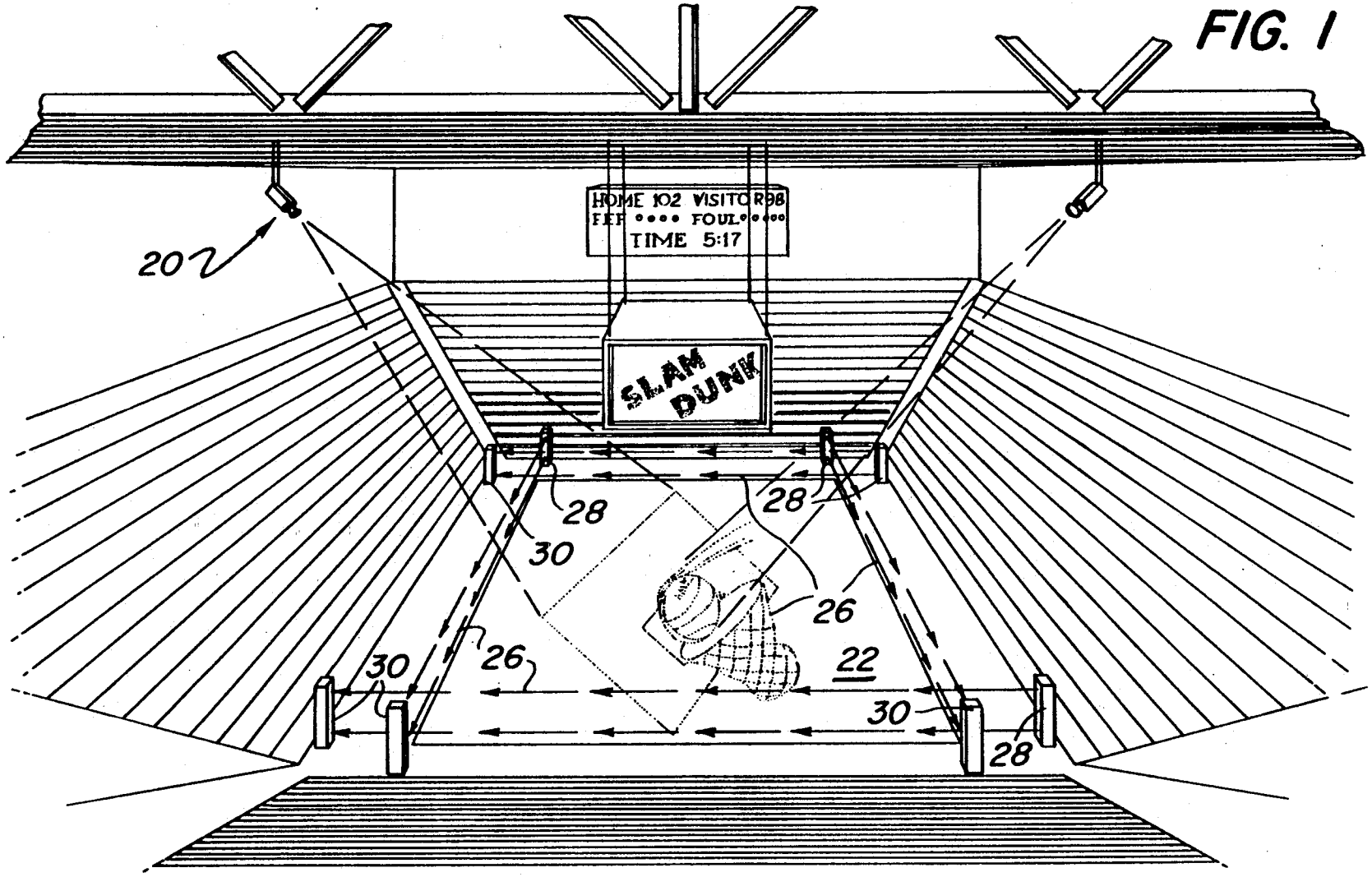
FIG. 1 is a perspective view of a typical arena, such as a basketball arena, utilizing the laser scanning/projection system of this invention.
Figure 4:
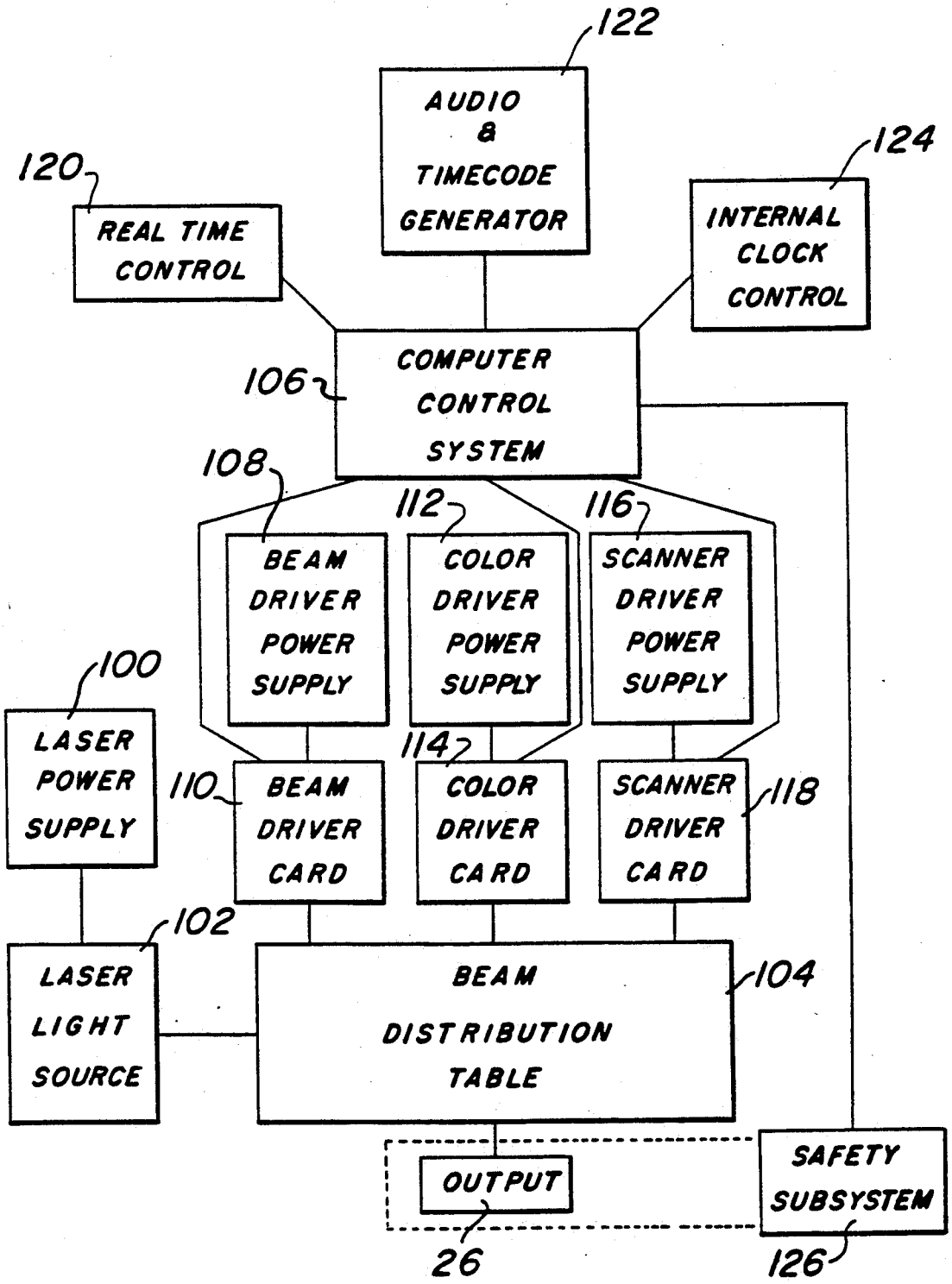
FIG. 4 is a block diagram of one embodiment of the subject invention.
Figure 5:
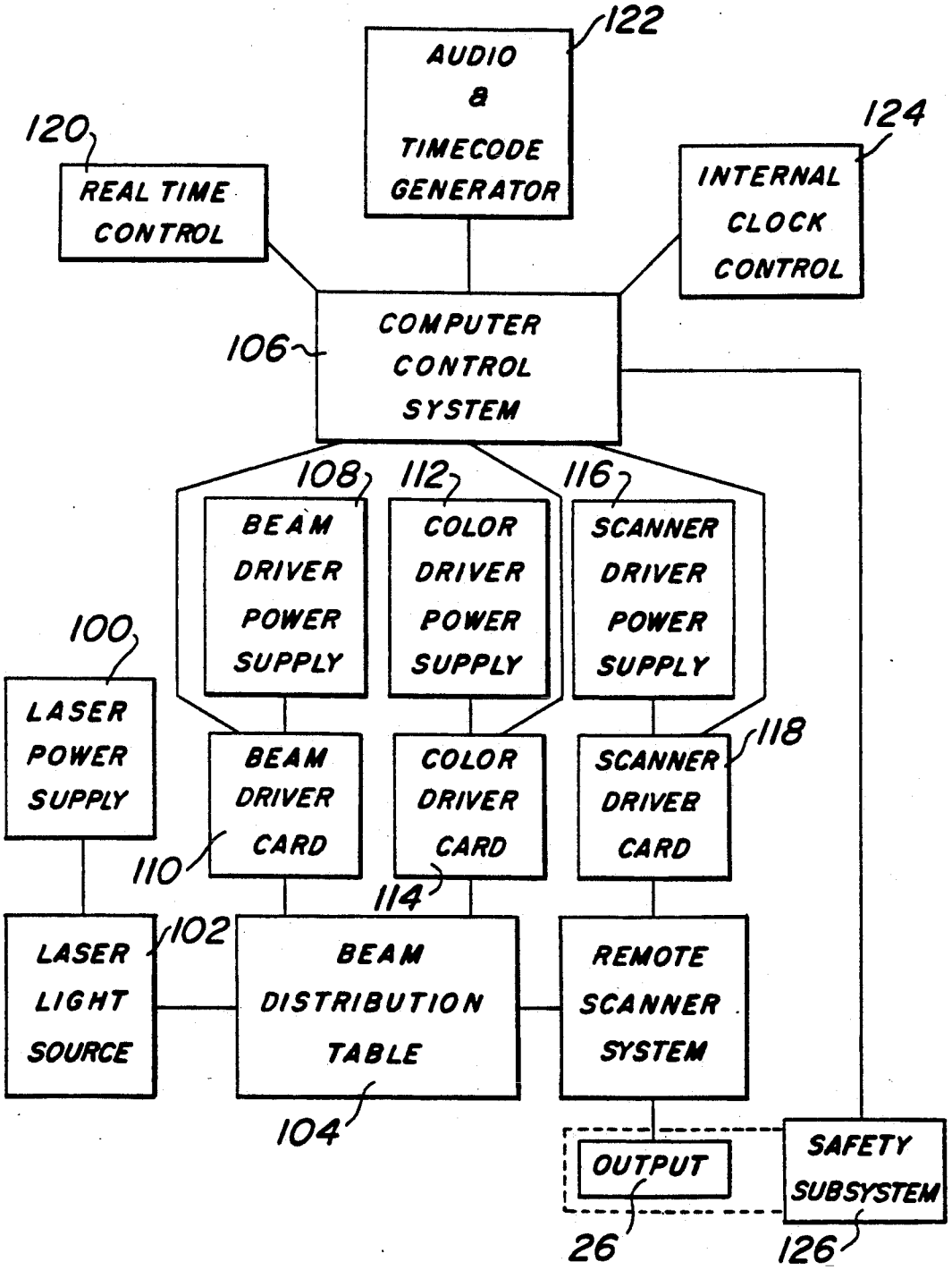
FIG. 5 is a block diagram of another embodiment of the subject invention.

Referring now to various figures of the drawing where like reference numerals refer to like parts there is shown at 20 in FIG. 1 a laser-based, "remote type" scanning/projection system constructed in accordance with one embodiment of this invention and shown in block diagram form in FIG. 5. The system 20 may also be configured in a "direct type" configuration as shown in block diagram form in FIG. 4. The details and operation of both types of systems will be described later. In either case the system 20 is arranged to be used at any desired venue, e.g., within any type of arena or other structure, where persons will be located to project an image onto the floor, wall, ceiling, or some other panel at that venue so as to be viewable by such persons.

Figure 2:
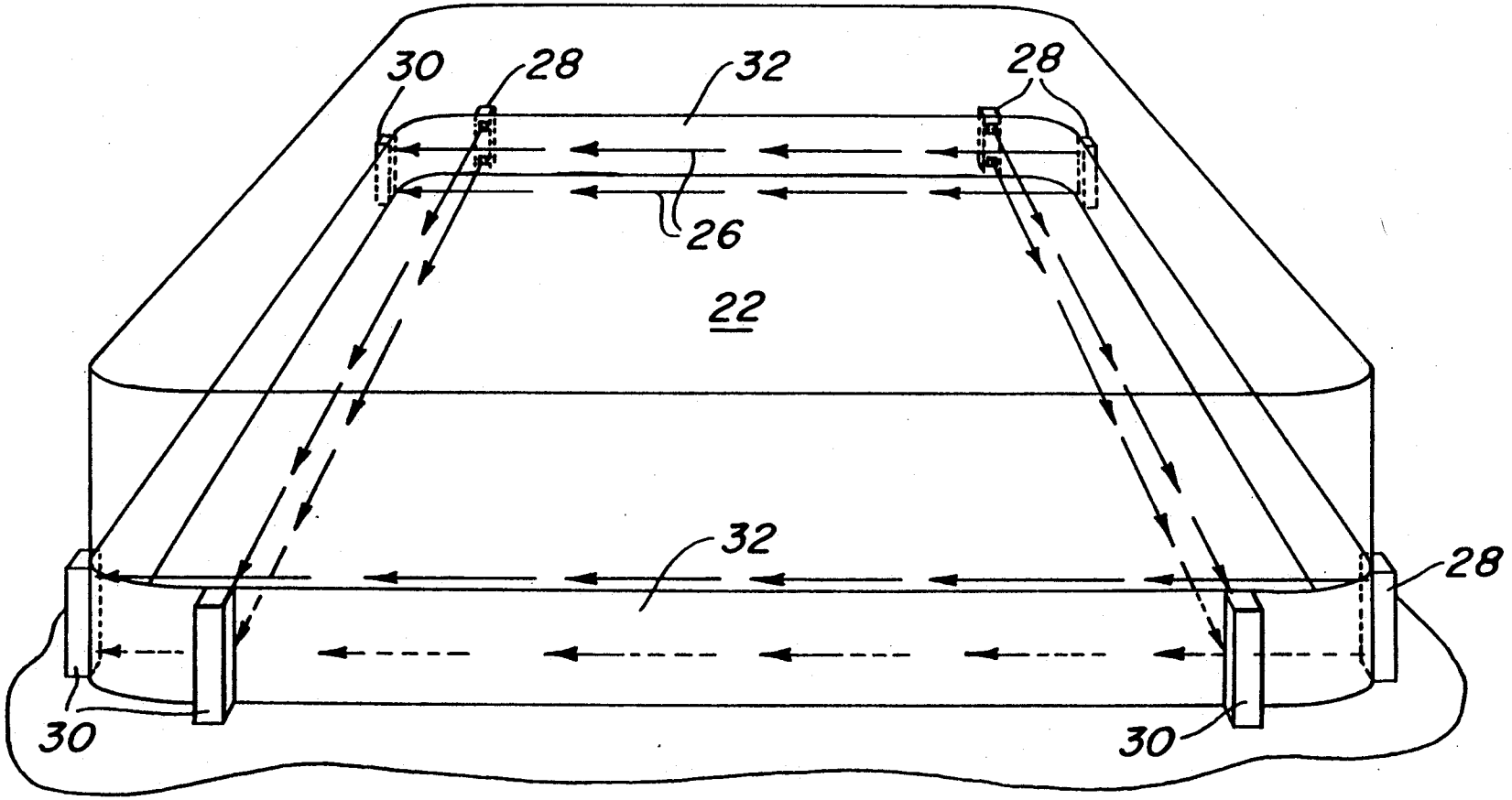
FIG. 2 is a perspective view of a portion of another typical arena, utilizing the laser scanning/projection system of this invention.

In the embodiments of the invention shown herein two common types of arenas are shown, namely, a basketball arena in FIG. 1, and a hockey arena in FIG. 2. Those types of structures are merely exemplary of the many types of buildings or structures in which the scanning/projection system of this invention may be used.

Irrespective of the type of arena or structure or outside area at which the system 20 is employed there will be some area, such as the playing floor 22, into which the laserbased image 24 is projected. In FIG. 1 the image is shown as a composite image projected onto the floor by a pair of remote projectors forming a portion of the remote type system 20. The direct type system 20 may also be used in this type of application. In any event in order to protect individuals, e.g., spectators, players, vendors, etc., who may intrude into the floor area on which the image 24 is projected the system 20 includes a safety subsystem (to be described in detail later). That subsystem serves to establish a perimeter or enclosure 26 about the floor area in which the laser beam is projected and for disabling the projection of the laser beam therein if an individual passes through that perimeter. This feature is of particular importance for application wherein the laser image is to be projected onto the playing field or floor of the structure since access by persons to that area cannot be prohibited with assurance. The safety subsystem of this invention is of importance even if the image is to be projected on surfaces other than the playing floor so long as it is possible for a person to intrude into the area in which the surface is located.

Before discussing the safety subsystem, its construction, location, and operation, a discussion of the overall scanning/projection system 20 is in order. To that end in FIG. 4 there is shown a "direct" version of the scanning system 20 constructed in accordance with the subject invention. That system utilizes a direct-from-the-source laser beam to create line art or other visually perceptible images, such as image 26, and to project the same onto a playing floor or other surface of an arena or other structure for effecting advertising, entertainment or informational purposes.

Thus, as can be seen in FIG. 4 the "direct" scanning/projection system 20 basically comprises a laser power supply 100, a laser light source 102, a beam distribution table 104, and other means (such as the safety subsystem) to be described later. The laser light source 102 is arranged to produce one or plural laser beams when provided with power from the laser power supply 100. Thus, the laser light source may comprise one or plural laser tubes of the same or different type. In the latter case beams of predetermined colors, e.g., a red Krypton beam, a green/blue Argon beam, etc. can be used to enhance the display's aesthetics. Any suitable commercially available laser tube and laser power supply may be used for the means 102 and 100, Examples of such devices are those available from Spectra Physics Corporation, Coherent Technologies, Inc., Laser Ionics, etc.

The laser beam(s) produced by the laser light source 102 is(are) provided to the beam distribution table 104. That table is a conventional or standard assembly arranged to accept the generated laser beam(s) from the source 102 and to distribute it(them) to various components mounted thereon, e.g., solenoids, galvanometers, refraction devices, mirrors, filters, etc., which operate on the laser beam(s) to produce the desired image and to project it onto the desired surface, e.g., the arena floor. Thus, the beam distribution table 104 includes beam altering means for optically modifying the beam(s) to create different visual effects, beam coloring means for coloring the laser beam(s), and beam scanning means for sweeping the laser beam(s) in the desired path to create the image and project it onto the display surface.

The beam altering means on the beam distribution table basically comprise beam directing devices, such as mirrors, which are mounted on solenoids for control purposes to direct the laser beam(s) to selected refractive components, e.g., pieces of shower glass, located on different portions of the table to produce different optical effects, e.g., Lumia type effects. Diffractive components may also be mounted on the solenoids for diffracting the beam(s) to alter its(their) visual effect. Any suitable conventional solenoids may be used, such as the model GM20 solenoid available from General Scanning, Inc.

Control of the solenoids on which the mirrors, refractive, and diffractive components are mounted is effected by a computer control system 106 and associated power supplies and drivers (all to be described later) forming other portions of the system 20.

The beam coloring means on the beam distribution table basically comprises filters, e.g., dichroic or color, to filter out unwanted light frequencies and thereby produce the desired coloration of the laser beam(s). The filters are mounted on solenoids so that their use may also be controlled under direction of the computer control system 106, as will also be described later. Like the beam modifying means, the beam coloring means may utilize any suitable conventional solenoids.

The beam scanning means on the beam distribution table basically comprise a pair of scanning mirrors whose movement is controlled by the computer control system 106. In particular such scanning means comprises a pair of orthogonally oriented scanning mirrors, each mounted on a respective galvanometer. Any suitable conventional galvanometer may be used, such as the model GP120D galvanometer from General Scanning, Inc. One mirror is mounted on one galvanometer for scanning or sweeping the laser beam(s) through a thirty degree arc about X axis, while the other mirror is mounted on another galvanometer for sweeping the laser beam(s) through a thirty degree arc about the Y axis. The beam(s) is(are) swept by the scanning mirrors at a high rate of speed, e.g., 1000 Hz. With the galvanometers geometrically aligned on the X and Y axis the laser beam(s) is(are) directed vectorialy through a path as called for by the computer control system 106. The persistence of vision of the human eye perceives the rapidly moving spot of laser light swept across the projection surface, e.g., arena floor, by the scanning mirrors as a solid line, whereupon the desired image appears on that surface.

The beam scanning means of the beam distribution table may also include a third galvanometer (also of conventional type) in the beam path and which mounts a shutter or some other light blocking element thereon t interrupt the beam at predetermined points to eliminate the beam from predetermined areas of the scanned image. This arrangement is particularly useful for blanking purposes, i.e., eliminating unwanted connecting lines of any particular image. Such blanking action may also be effected through the use of acoustic or electronic oscillation or modulation of the beam(s) at its(their) source.

The computer control system 106 serves as the hub of the operating system of the scanning/projection system 20. Thus, the system 106 is arranged to receive external commands, such as real time or SMPTE information, to process that information, and responsive thereto effect the control of the various components making up the system 20. Any suitable conventional computer control system can be utilized. One such system is that sold by Lasermedia, Inc. under the designation Imagen.

In any event the system 106 includes a CPU which is arranged to receive an external command, to interpret and execute it. To achieve that end the CPU draws the information needed to execute the command from a module program chip, as in the case of a preprogrammed module, or from an individual image chip, as in the case of real time application. If information is drawn from the module chip, the CPU will then draw from the individual image chips as they become necessary during the program run. After the image is made available, the information in the form of digital output signals is transferred to various driver power supplies and associated drive cards (to be described hereinafter) where the digital signals are converted into analog signals and amplified for provision to the beam distribution table. Thus, as can be seen in FIG. 4 the system 20 also includes a beam driver power supply 108 and an associated beam driver card 110, a color driver power supply 112 and an associated color driver card 114, and a scanner driver power supply 116 and an associated scanner driver card 118.

The beam driver power supply 108, the color driver power supply 112, and the scanner driver power supply each are conventional components arranged to convert 120 VAC to (+) or (−) 15 VDC for use by the solenoids and galvanometers of the beam distribution table 104. The beam driver card 110, the color drive card 114, and the scanner driver card 118 are also each conventional devices, i.e.., an analog-to-digital converter with an associated amplifier, for converting the digital output signals from the computer controller system 106 into millivolt analog signals and for amplifying those signals to + or −15 VDC to control/drive the solenoids and galvanometers of the beam distribution table 104. Any suitable conventional driver card can be utilized for the drivers 110, 114 and 118. One such card for making up the drivers 110 and 114 is the PC22A card sold by Lasermedia, Inc., while the scanner driver card may be the LM22SDA card sold by Lasermedia, Inc.

As mentioned earlier the computer control system 106 is arranged for real time control of the images generated by the system 20. Simply put, such control is the manipulation of stored image information by an operator on site at the arena during the sporting event or performance. An example of such stored information is in the form of word scrolling for special messages or announcements of upcoming or special events, etc. which may be initiated immediately by the operator during a time out or other pause in the action after the participants (players) or other persons have left the floor or other area onto which the image is to be projected.

In the system 20 real time control is effected by the real time control means 120. Such means basically comprises a standard keyboard which communicates with the computer control system 106 to generate the images requested, as well as the manipulation of the geometric axis, color, size, and other parameters of the projected image.

Another input to the computer control system 106 is provided by the audio and timecode generator 122. The time code generator may be applied in any fashion to the computer control system 106 so long as it is capable of providing SMPTE code thereto. One example of a time code with audio is a specific music theme which is recorded on tracks one and two of a four track cassette recorder, such as a TEAC 234 deck, while track four includes the SMPTE time code on it to keep the images synchronized with the music tracks. During the programming of the imagery to the music, the SMPTE code is referred to and constantly aligned for this purpose. With such an input to the computer control system 106 preprogrammed audio modules in the form of team or sponsor theme songs, cheers, popular music, etc., can be called up at any time.

Another "input" to the computer control system 106 may be in the form of internal clock control means 124 for controlling the operation of the internal clock in the computer control system. Such means may be used in a stand alone fashion for real time preprogrammed volatile graphics modules or in coordination with preprogrammed non-volatile SMPTE coded modules.

In FIG. 5 there is shown the "remote" version of the scanning system 20 constructed in accordance with the subject invention. As can be seen therein the system is basically the same as that shown in FIG. 4 except that the beam distribution table is in a remote location. In this system the laser beam is fed into an optical coupler and injected into a 100 micron optical fiber. The laser-light is carried by the optical fiber to a remote unit which contains the scanner driver power supply, the scanner driver card and scanning means, e.g., galvanometer mounted scanning mirrors. In such an arrangement the beam is collimated and aimed at the galvanometer mirrors for projection into the area 22. The remote scanning/projection system shown in FIG. 5 is advantageous where space does not permit a full table system, i.e., the system of FIG. 4.

As mentioned earlier the system 20 of this invention, be it the "direct" system of FIG. 4 or the "remote" system of FIG. 5, includes a safety subsystem to disable the laser beam projecting means via the computer control system 106. The disabling of the beam in the event that a person should attempt to intrude into the area into which the laser beam(s) is(are) projected serves not only to safeguard the general public but also to meet the standards set forth by the Bureau of Radiological Health (CDRH), a division of the Food and Drug Administration. The safety subsystem is shown in FIGS. 4 and 5 where it is designated by the reference numeral 126.

Figure 3:
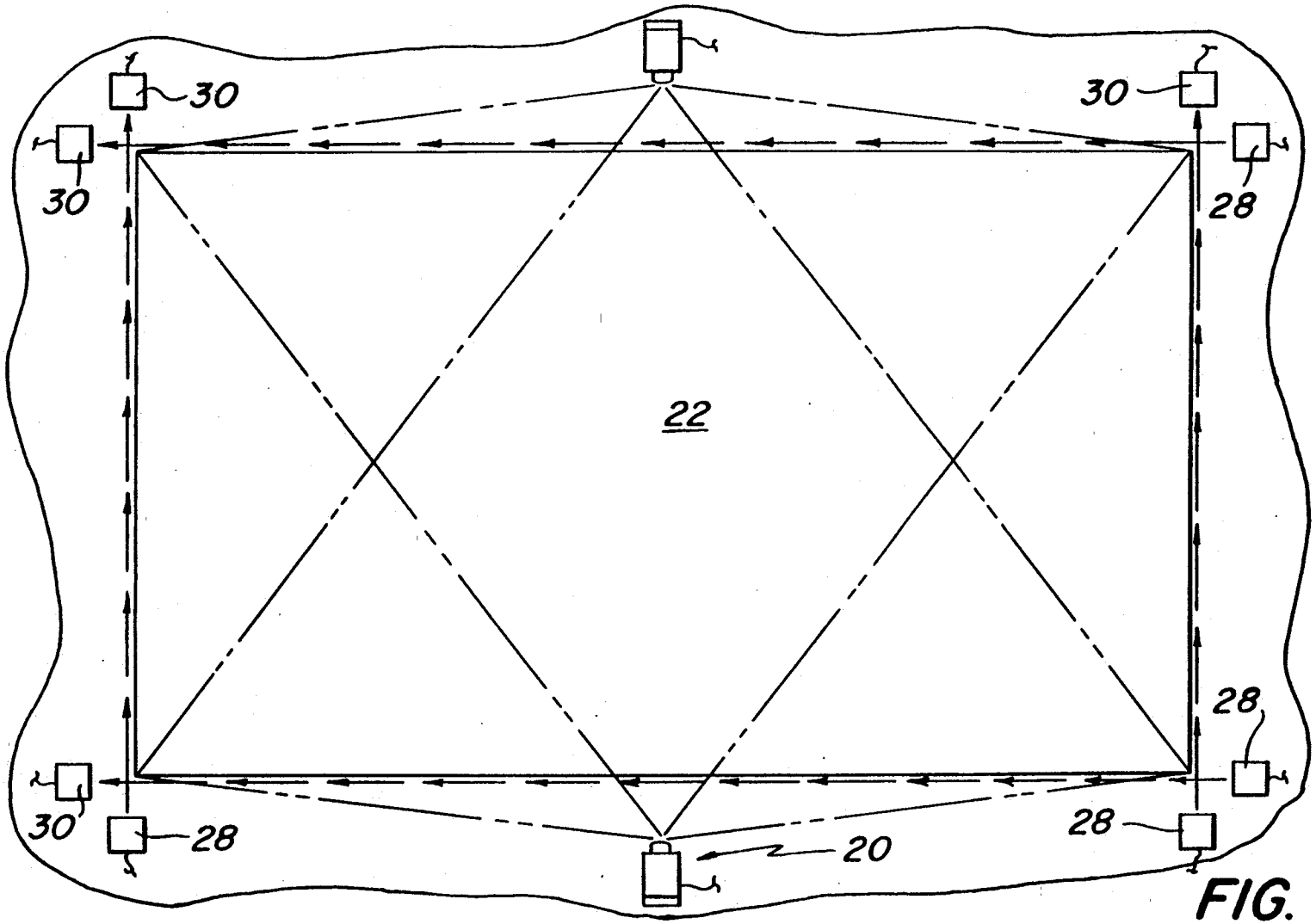
FIG. 3 is a plan view of a typical arena floor about which the protective means of the laser scanning/projection system of this invention are disposed.

As can be seen in FIGS. 1-3 the subsystem 126 basically comprises plural, conventional infrared transmitters and associated conventional infrared receivers, e.g., photocells or phototransistors. The transmitters and receivers are disposed in respective housings or towers 28 and 30, which are paired to define respective sides of the perimeter or enclosure 26. Thus one transmitter tower 28 is located at one corner of the floor's perimeter 26 and the associated or paired receiver tower 30 is located at the immediately adjacent corner to define therebetween one side of that perimeter. Each of the transmitters produces a beam of electromagnetic radiation, e.g., infrared radiation, denoted by the arrows in FIGS. 1-3, and directs that beam out of its tower 28 to it's associated receiver located in tower 30. Accordingly, the infrared beam forms a side of the enclosure 26.

In the preferred embodiments of the invention shown in FIGS. 1-3 each of the transmitter towers 28 includes two transmitters, one above the other, while each of the receiver towers 30 includes two receivers, one above the other and located at the same height as the transmitters in the transmitter tower. Thus, the infrared beams define two tiers, one above the other. Each receiver is connected into the system 20 so that when the infrared beam from its paired transmitter is broken, as would occur if a person moves from outside the perimeter 26 through one of it's sides, an electrical signal is provided.

In one preferred embodiment of this invention the electrical signal indicating intrusion into the enclosure is provided to the computer control system 106 to automatically disable the scanning/projection operation and thus terminate the display 26. In another embodiment of this invention the electrical signal may be provided to the either audible or visible indicator means in the system 20 to signal the operator of the intrusion of a person into the enclosure, whereupon the operator may manually disable the scanning/projection operation via keyboard entry.

It should be pointed out at this juncture that in most circumstances only two tiers of components will be required, but additional tiers may be incorporated depending on the requirements of the installation. The location of the towers 28 and 30 forming the enclosure is a function of the type of area into which the laser beam image is to be projected. In practice, the towers are preferably located in such a manner as to allow maximum scanning space on the floor, while establishing a minimum distance of 2.5 linear meters between the audience and the scanned area is maintained at all times. Preferably, the distance between the infrared beam and the scan area is 2.5 linear meters, allowing the infrared beam(s) to be broken and the system disabled before the encroaching party were to ever reach the scan area.

The infrared transmitters and receivers need not be disposed in towers like that described heretofore. Thus, they can be custom installed in various ways about the area to be protected to meet the requirements of the physical layout of the arena. In the case of ice rinks, like that shown in FIG. 3 the transmitter and receiver towers are installed in the rink boundary walls 32, with the transmission and receptacle photo cell diodes encased in NEMA 4 type enclosures behind a protective sheet of high density, anti-reflective lexan. In an open court installation, such as that shown in FIG. 1, physical location of the towers will vary, and again can be custom installed to meet the physical demands of the arena layout, recessed back enough not to pose any physical harm to players, yet sufficiently visible so as not to present a tripping hazard by normal crowd movement. Where this cannot be attained, hydraulic recessed transmitter and receiver towers can be incorporated in the areas where the system is required.

As should be appreciated by those skilled in the art the number of towers making up the subsystem 126 can be reduced from that shown by combining transmitters and receivers into a single housing or tower, thereby reducing from eight to four the number of enclosures on the arena floor.

In accordance with a preferred method of use of this invention once the display has been terminated, the scanning/projection system would only be reactivated upon the removal of the persons from the scanning area.

Without further elaboration the foregoing will so fully illustrate my invention that others may, by applying current or future knowledge, adopt the same for use under various conditions of service.

I claim:

1. An image projection system for use at a venue having a field onto which an image is to be projected thereby, said system comprising laser means and control means for generating and projecting said image onto said field, said projection system additionally comprising a safety override means coupled to said control means for determining if a living being is approaching said field and for providing an electrical signal so that said image may be terminated in response thereto, said safety override means comprising means for establishing an enclosure, with an area larger than said field, around the periphery of said field and for providing said electrical signal should a living being traverse said enclosure.

2. The system of claim 1 wherein said control means comprises computer means and wherein said electrical signal is provided to said computer means.

3. The system of claim 1 wherein said enclosure is established by electromagnetic radiation.

4. The system of claim 3 wherein said electromagnetic radiation comprises infrared radiation.

5. The system of claim 4 wherein said safety override means comprises transmitter means and associated receiver means, said transmitter means producing said infrared radiation and directing it along the periphery of said enclosure to said receiver means.

6. The system of claim 4 wherein said electromagnetic radiation is provided in at least two tiers along the periphery of said field.

7. The system of claim 3 wherein the periphery of said enclosure has sides and wherein said safety override means comprises transmitter means and associated receiver means, said transmitter means producing said electromagnetic radiation and directing it along the periphery of said enclosure to said receiver means, with at least one paired transmitter and receiver means defining each side.

8. The system of claim 3 wherein said electromagnetic radiation is provided in at least two tiers along the periphery of said field.

9. The system of claim 1 wherein said system includes means for automatically terminating said display upon receipt of said electrical signal.

10. The system of claim 9 wherein said safety override means comprises means for establishing an enclosure, with an area larger than the area of said field, about the periphery of said field and for providing said electrical signal should a living being traverse said enclosure.

11. The system of claim 10 wherein said enclosure is established by electromagnetic radiation.

12. The system of claim 11 wherein said electromagnetic radiation comprises infrared radiation.

13. The system of claim 11, wherein the periphery of said enclosure has sides and wherein said safety override means comprises transmitter means and associated receiver means, said transmitter means producing said electromagnetic radiation and directing it along the periphery of said enclosure to said receiver means, with at least one paired transmitter and associated receiver defining each side of said periphery.

14. The system of claim 13 wherein said electromagnetic radiation is provided in at least two tiers along the periphery of said enclosure.

15. The system of claim 9 wherein said control means comprises computer means and wherein said electrical signal is provided to said computer means to effect the automatic termination of said display.

16. The system of claim 1 wherein said system includes means to enable said display to be manually terminated in response to receipt of said electrical signal.

17. The system of claim 16 wherein said safety override means comprises means for establishing an enclosure, having an area larger than the area of said field, about the periphery of said field and for providing said electrical signal should a living being traverse said enclosure.

18. The system of claim 16 wherein said enclosure is established by electromagnetic radiation.

19. The system of claim 18 wherein said electromagnetic radiation comprises infrared radiation.

20. The system of claim 18 wherein the periphery of said enclosure has sides and wherein said safety override means comprises transmitter means and associated receiver means, said transmitter means producing said electromagnetic radiation and directing it along the periphery of said enclosure to said receiver means, with at least one paired transmitter and receiver means defining each side.

21. The system of claim 20 wherein said electromagnetic radiation is provided in at least two tiers along the periphery of said field.

22. The system of claim 16 wherein said control means comprises computer means and wherein said system additionally comprises means for providing a manual signal to said computer means to effect the manual termination of said display.

23. A method of projecting a laser beam onto a field at a venue to produce a visually perceptible image thereon, said method comprising establishing a predetermined perimeter around said field including an area larger than the area of said field, generating and projecting said image into said field, and terminating the projection of said image onto said field in the event that a person should pass through said perimeter.

24. The method of claim 23 wherein said termination of said projection is automatically effected in response to said person passing through the perimeter.

25. The method of claim 24 wherein said perimeter is established by electromagnetic radiation.

26. The method of claim 25 wherein said electromagnetic radiation comprises infrared radiation.

27. The method of claim 25 wherein said electromagnetic radiation is provided in at least two tiers.

28. The method of claim 23 wherein said termination of said projection is manually effected in response to said person passing through the perimeter.

29. The method of claim 28 wherein said perimeter is established by electromagnetic radiation.

30. The method of claim 29 wherein said electromagnetic radiation comprises infrared radiation.

31. The method of claim 29 wherein said electromagnetic radiation is provided in at least two tiers.

32. The method of claim 23 wherein said perimeter is established by electromagnetic radiation.

33. The method of claim 32 wherein said electromagnetic radiation comprises infrared radiation.

34. The method of claim 32 wherein said electromagnetic radiation is provided in at least two tiers.

* * * * *